US006499396B1

(12) United States Patent
Hillebrand

(10) Patent No.: US 6,499,396 B1
(45) Date of Patent: Dec. 31, 2002

(54) WEB-FED ROTARY PRESS

(75) Inventor: Bernd Anton Hillebrand, Bergrheinfeld (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/868,639

(22) PCT Filed: Dec. 23, 1999

(86) PCT No.: PCT/DE99/04090

§ 371 (c)(1),
(2), (4) Date: Jun. 28, 2001

(87) PCT Pub. No.: WO00/40412

PCT Pub. Date: Jul. 13, 2000

(30) Foreign Application Priority Data

Dec. 30, 1998 (DE) ..... 198 60 928

(51) Int. Cl.[7] ..... B41F 5/06; B41F 8/10
(52) U.S. Cl. ..... 101/221; 101/216; 101/217
(58) Field of Search ..... 101/176, 177, 101/178, 179, 180, 181, 217, 219, 220, 221

(56) References Cited

U.S. PATENT DOCUMENTS 5,555,803 A 9/1996 Holm
5,640,906 A 6/1997 Schmitt
5,950,538 A * 9/1999 Puschnerat ..... 101/180
6,186,064 B1 * 2/2001 Dufour ..... 101/180

FOREIGN PATENT DOCUMENTS

| | | |
|---|---|---|
| DE | 1 827 845 | 3/1961 |
| DE | 29 28 538 | 2/1980 |
| DE | 94 21 112 | 6/1995 |
| DE | 94 21 284 | 9/1995 |
| DE | 44 29 891 | 2/1996 |
| DE | 195 27 889 | 7/1997 |
| EP | 0 246 081 | 11/1987 |

* cited by examiner

*Primary Examiner*—Andrew H. Hirshfeld
*Assistant Examiner*—Jill Culler
(74) *Attorney, Agent, or Firm*—Jones, Tullar & Cooper, P.C.

(57) ABSTRACT

A web-fed rotary printing press includes at least two printing units each of which has two print units. The two print units are situated adjacent each other and form a double print unit or print unit module. Several double print units or printing units can be situated one after the other. One of the printing units can be shifted with respect to the other printing unit to afford access to each print unit for maintenance work.

11 Claims, 1 Drawing Sheet

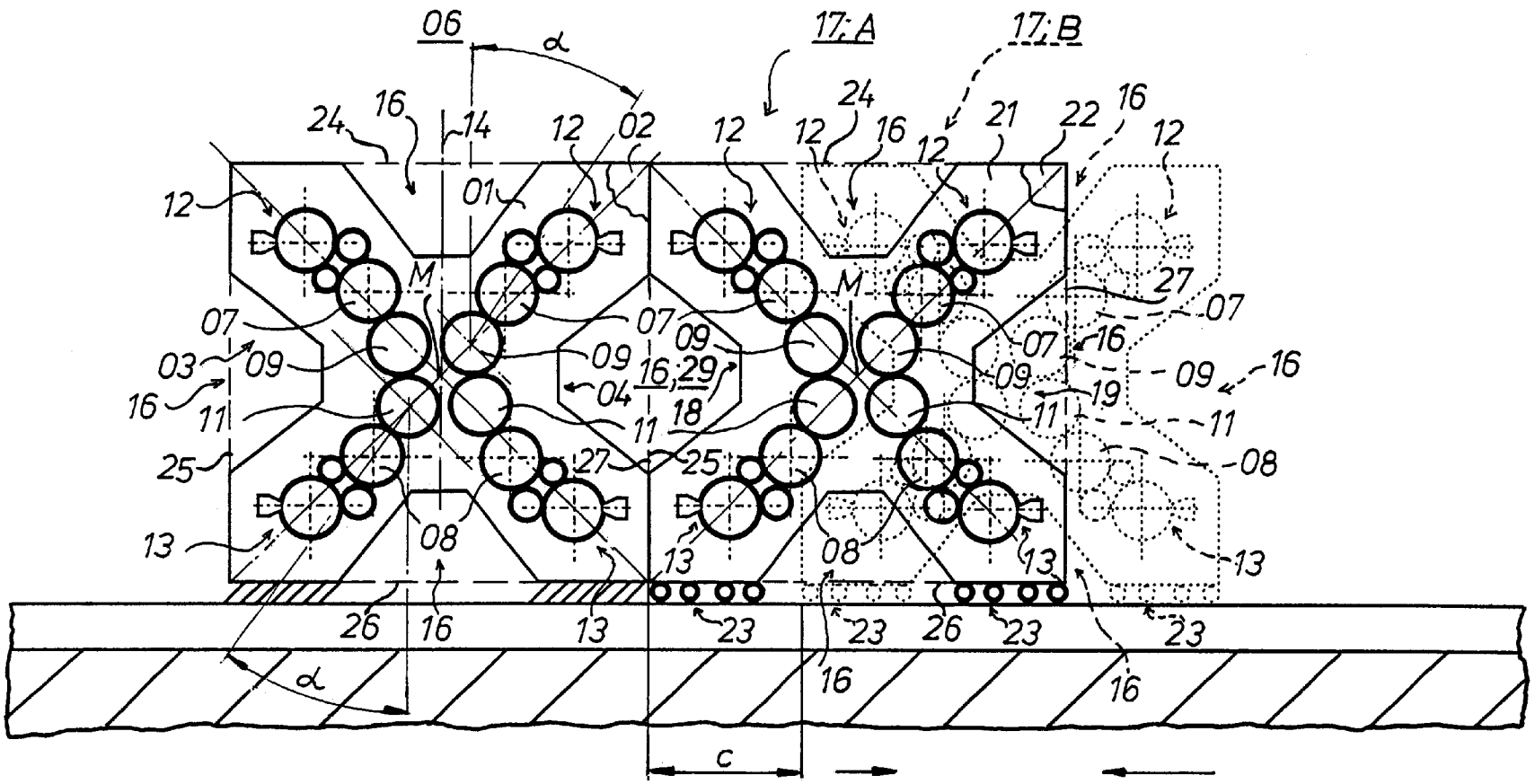
17:B
17:A
06
α
c
M
01
02
03
04
07
08
09
11
12
13
14
16
18
19
21
22
23
24
25
26
27
29

WEB-FED ROTARY PRESS

FIELD OF THE INVENTION

The present invention is directed to a web-fed rotary printing press having a plurality of printing units. Each unit has four transfer cylinders and four associated forme cylinders. The distance between at least two of the printing units or their spatial orientation can be changed or varied.

DESCRIPTION OF THE PRIOR ART

So-called I-type printing units are generally known. They typically consist of two forme cylinders arranged in a vertical plane, to which two rubber blanket cylinders have respectively been assigned. Several I-type printing units are arranged behind each other and spaced apart. See, for example, DE 44 29 891 A1.

DE 29 28 538 A1 describes, and depicts, an offset printing unit for a selectably horizontal or vertical web running direction.

EP 0 246 081 A2 discloses an offset printing unit with a horizontal web path, which can be turned for changing colors or formats. A change in the web path is not provided in this device

SUMMARY OF THE INVENTION

The object of the present invention is directed to creating a web-fed rotary printing press.

In accordance with the present invention, this object is attained by providing a printing press having a plurality of printing units. Each printing unit has four transfer cylinders and four associated forme or plate cylinders. The printing units can either be arranged next to each other in the horizontal direction and shiftable with respect to each other, or can be rotatable about 90° for use with either horizontal or vertical web running directions.

The advantages which can be obtained by the present invention reside, in particular, in that a space-saving arrangement of the printing device has been created as a result of a shortened distance between the printing units spaced apart in the horizontal direction. The fan-out effect of the paper web is reduced because of the shortened distance. For maintenance purposes, the printing unit modules are accessible from both sides after the lateral frames have been rolled or moved away. The running direction of the paper web can be changed by individual drive mechanisms for each forme cylinder or rubber blanket cylinder unit.

It is furthermore advantageous that the printing device in accordance with the invention, in the form of so-called H-type printing units, also arranged several times above each other, can be employed with a vertical web travel path. There are more than ten different options for the running direction of a web of material to be imprinted in the web-fed rotary press of the present invention.

BRIEF DESCRIPTION OF THE DRAWINGS

A preferred embodiment of the present invention is represented in the sole drawing and will be described in greater detail in what follows. The sole drawing FIGURE shows the schematic representation of two printing unit modules in accordance with the present invention in a lateral view.

DESCRIPTION OF THE PREFERRED EMBODIMENT

Two print units 03, 04, oriented in the vertical or generally vertical direction, are both embodied as double printing units positioned one after the other and constitute the first printing unit 06 situated in a common frame, or between two opposite located lateral frames 01, 02, respectively for the so-called driven side, or operating side.

The first print unit 03 consists of two forme cylinders 07, 08, which are arranged in a vertical or approximately vertical direction above each other and are spaced apart from each other. A rubber blanket cylinder 09, 11 is assigned to each forme cylinder 07, 08, respectively. At least the rubber blanket cylinders 09, 11 are seated in double eccentric bushings, so that they can be placed against, or moved away from each other or against the corresponding rubber blanket cylinders 09, 11 of the second print unit 04, which corresponding blanket cylinders are arranged mirror-reversed in respect to them. A web of material, for example a paper web, runs between the rubber blanket cylinders, which can be placed against each other, so that it is possible to produce a 1/1 printing. An ink unit, for example a short ink unit 12, 13, is assigned to each forme cylinder 07, 08 to accomplish, for example, dry offset printing in accordance with DE 195 27 889 C2. If required, it is also possible to assign a known damping unit, which is not specifically represented, to each forme cylinder 07, 08.

The direction of rotation of the cylinders 07, 08, 09, 11, and therefore the running direction of a paper web, can be reversed by use of an individual drive mechanism, also not specifically represented. A position-controlled electric motor, for each forme cylinder and rubber blanket cylinder unit 07, 08, or 09, 11 can be used as the drive mechanism. It is, of course, also possible to equip each cylinder 07, 08, 09, 11 with its own position-controlled electric motor.

The second print unit 04, in an I-type construction, is arranged in respect to the first print unit 03 mirror-reversed with respect to an imaginary vertical line 14 extending between the print units 03, 04. For this reason, the same reference numerals are employed for like components of the print unit 04.

The lateral frames 01, 02 used for the first printing unit 06 have, respectively, a square, or nearly square, or a diamond-shaped, or nearly diamond-shaped form. An incision 16 extends, starting at each one of the four lateral faces 24, 25, 26, 27 of the lateral frame 01, 02, and runs in the direction toward the respectively next rubber blanket cylinder 09, 11. Each incision 16 has a square, rectangular, triangular, semi-circular or semi-elliptical form. These incisions 16 taper in the direction toward the rubber blanket cylinders 09, 11, starting at the lateral faces 24 to 27, or respectively the contour of the respective lateral face 01, 02.

A second printing unit 17 also consists of two print units 18, 19, which are also located directly adjacent each other, and are arranged in second lateral frames 21, 22. The cylinders and ink units of the second printing unit 17 are embodied the same as those of the first printing unit 06, so that the same reference numerals are also used.

The lateral frames 21, 22 of the second printing unit 17 are arranged displaceably and can be stopped or arrested, in the horizontal direction, for example by rollers 23 running in guides. By this, it is possible to move the printing unit 17, which is in a work position A, into a rest or maintenance position B, which is remote from this work position A and which position B is shown in dashed lines.

It is also possible to arrange more than two printing units 06, 17 behind or after each other. By the displacement of the printing unit 17 in the horizontal direction, transversely to the axis of rotation of one of its forme cylinders 07, 08, by a defined amount "c", for example an amount "c" approximately 80 cm, each printing unit 06, 17 is accessible from each side.

At least one printing unit should be movably arranged and, when using a plurality of printing units, preferably at least one printing unit should be arranged fixed in place.

With an arrangement of a plurality of printing units 06, 17 in the horizontal paper running direction, the printing units can be arranged, lined up closely or at a short distance from each other, and can be stopped or arrested. By the above arrangement, an opening 29 for maintenance and/or for the access of a person between the lateral frames 01, 02, or 21, 22, is created between the lateral faces 27, 25 of adjoining printing units 06, 17 because of the incisions 16.

Each one of the printing units 06, 17 has a virtual horizontal center axis M extending in an axis-parallel direction with the cylinders 07, 08, 09, 11. This center axis M is located in the intersection of two crossing diagonal lines of each lateral frame 01, 02, 21, 22, as seen in the sole drawing FIGURE.

Straight lines, defined by the axes of rotation of a transfer cylinder 09, 11, and an associated forme cylinder 07, 08, form an opening angle a of ±30° to ±60° with a vertical line.

Each printing unit 06, 17 can be installed to be pivotable by 90° around its center axis, so that the printing units 06, 17 can also be employed for a vertical web running direction.

Because of the above fact, the printing units 06, 17 can also be arranged on top of each other; i.e., the printing units 06, 17 are stackable.

While preferred embodiments of a web-fed rotary press in accordance with the present invention have been set forth fully and completely hereinabove, it will be apparent to one of skill in the art that a number of changes in, for example the overall sizes of the cylinders, the type of web being printed and the like could be made without departing from the true spirit and scope of the present invention which is accordingly to be limited only by the following claims.

What is claimed is:

1. A web-fed rotary printing press comprising:

at least first and second printing units, each of said at least first and second printing units having four transfer cylinders and four forme cylinders, each one of said forme cylinders being associated with a corresponding one of said transfer cylinders, two of said four transfer cylinders in each of said at least first and second printing units being arranged to work together; and first and second spaced lateral frames supporting said first printing unit and third and fourth spaced lateral frames supporting said second printing unit said first and second printing units being adjacent each other in a longitudinal direction at a distance, said distance being changeable, each of said first, second, third and fourth lateral frames having four lateral faces, each of said four lateral faces of each of said lateral frames having an inwardly extending incision, each of said inwardly extending incisions facing toward said four transfer cylinders in each of said associated one of said at least first and second printing units.

2. The web-fed rotary printing press of claim 1 wherein two of said transfer cylinders and two of associated forme cylinders in each of said printing units are arranged along a diagonal direction of each said printing unit.

3. The web-fed rotary printing press of claim 1 wherein a straight line defined by an axis of rotation of one of said four transfer cylinders and an axis of rotation of its associated one of said four forme cylinders in each of said at least first and second printing units forms an angle of between ±30° to ±60° with a vertical line.

4. The web-fed rotary press of claim 1 wherein a web to be printed extends generally horizontally between said at least first and second printing units.

5. The web-fed rotary printing press of claim 1 wherein transfer cylinders of each of said at least first and second printing units supported adjacent each other in the horizontal direction are arranged to be placed against and away from each other.

6. The web-fed rotary printing press of claim 1 wherein the transfer cylinders of each of said at least first and second said printing units which are arranged directly below each other in a vertical direction are arranged to be placed against and away from each other.

7. The web-fed rotary printing press of claim 1 wherein said incisions taper toward said transfer cylinders.

8. The web-fed rotary printing press of claim 1 wherein said printing units are arranged adjacent each other in a horizontal running direction of a paper web.

9. The web-fed rotary printing press of claim 8 wherein at least one of said horizontally adjacent printing units is horizontally shiftable and can be arrested in a shifted position.

10. The web-fed rotary printing press of claim 1 further wherein adjacent incisions of directly adjoining ones of said at least first and second printing units form openings, said openings being useable by a press operator.

11. The web-fed rotary printing press of claim 1 further including at least one short inking unit associated with each one of said forme cylinders.

* * * * *